United States Patent [19]

Musick et al.

[11] Patent Number: 4,565,910

[45] **Date of Patent: * Jan. 21, 1986**

[54] SWITCH APPARATUS RESPONSIVE TO DISTORTION

[75] Inventors: Jeff L. Musick; Robert D. Blaker; David G. Blaker, all of Tulsa, Okla.

[73] Assignee: Bed-Check Corporation, Tulsa, Okla.

[ * ] Notice: The portion of the term of this patent subsequent to Nov. 20, 2001 has been disclaimed.

[21] Appl. No.: 673,118

[22] Filed: Nov. 19, 1984

Related U.S. Application Data

[63] Continuation-in-part of Ser. No. 429,047, Sep. 30, 1982, Pat. No. 4,484,043.

[51] Int. Cl.[4] ..... H01H 3/02

[52] U.S. Cl. ..... 200/85 R; 200/86 R

[58] Field of Search ..... 200/5 A, 85 R, 86 R

[56] References Cited

U.S. PATENT DOCUMENTS

| | | | |
|---|---|---|---|
| 3,860,771 | 1/1975 | Lynn et al. | 200/5 A |
| 4,194,099 | 3/1980 | Mickelson | 200/86 R X |
| 4,237,358 | 12/1980 | Larson et al. | 200/86 R X |
| 4,484,043 | 11/1984 | Musick et al. | 200/86 R X |

*Primary Examiner*—J. R. Scott

*Attorney, Agent, or Firm*—Head, Johnson & Stevenson

[57] ABSTRACT

An improved switch apparatus for monitor presence of the patient in a hospital or nursing home bed and responsible to distortion by the weight of the patient, the switch being formed of an elongated, thin rectangular base member of insulating, flexible material having an elongated generally rectangular cutout in it, a first and second plastic cover members encompassing the base member, the plastic cover members being sealed around the edges and the plastic cover members having conductive layers affixed to the opposed surfaces on either side of the base member and arranged so that the conductive layers are spaced apart from each other in the area of the cutout and held apart by the memory of the base and plastic covers and a cable having one conductor connected to the conductive layer on one cover member and another conductor connected to the conductive layer on the other cover member, the conductive surfaces contacting each other through the cutout in the base member when the switch apparatus is subject to bending or twisting distortion.

3 Claims, 6 Drawing Figures

SWITCH APPARATUS RESPONSIVE TO DISTORTION

CROSS-REFERENCE

This is a continuation-in-part of application Ser. No. 429,047 filed Sept. 30, 1982 and entitled "Switch Apparatus Responsive to Pressure or Distortion", now U.S. Pat. No. 4,484,043 issued Nov. 20, 1984.

SUMMARY OF THE INVENTION

One continuous problem encountered in hospitals and nursing homes is that of patients evacuating a hospital bed when the patient is not of a condition so that he or she can be safely trusted out of bed. Many instances have been reported of elderly or infirm patients evacuating hospital beds and falling, breaking bones or causing injury to themselves. Other patients are sometimes disoriented and confused because of an unfamiliar environment or the effect of drugs utilized for treatment purposes and can wander about, even sometimes leaving the hospital. Under these conditions it is important that attendants be apprised if a patient leaves a hospital bed. To provide equipment to accomplish this purpose, bed monitoring devices have been developed such as disclosed in previously issued U.S. Pat. Nos. 4,179,692 and 4,295,133.

In order for electronic circuitry to function properly to indicate the evacuation of a bed by a patient, a convenient and dependable switch mechanism must be provided to open and close a circuit. The present invention provides an improved switch apparatus for this purpose and particularly one which is economical to construct, easy to use, and is more dependable than previously known types of switching devices.

The switch apparatus includes an elongated, thin, generally rectangular base member of insulating flexible material such as high-density polyethylene foam. The base portion is preferably about 1/16 inch thick and $3\frac{1}{2}$ to 5 inches wide and about 25 to 40 inches long. Formed in the base member is a generally rectangular cut out opening which is preferably about $1\frac{3}{4}$ to $2\frac{1}{4}$ inches wide and of a length of about $1\frac{1}{2}$ to 2 inches less than the length of the base member.

In a first embodiment there is secured on opposite faces of the base member a first and second generally rectangular, thin, electrically conductive member. The electrically conductive members may be such as foil or foil backed with plastic, or metallized plastic material. These are secured to the base member such as by adhesive. The base member thereby supports the conductive elements normally spaced apart from each other about 1/16 of an inch. A cable having two conductors is provided, a conductor being connected to each of the conductive members. Over this assembly is positioned plastic cover members which are slightly longer and wider than the base member and the conductive elements so that the cover members may be sealed along the peripheral edges, thereby completely sealing the apparatus.

The conductive elements are bonded to the cover members and are held in spaced apart relationship at the opening formed in the base member as long as the apparatus is not subject to weight or distortion. It can be positioned under a patient and, more particularly, under sheets, bedding or the like positioned on top of a mattress. The device need not come into contact with the patient. When the device is placed on a bed which receives a patient, the weight of the patient will distort the apparatus, causing the conductive elements to contact each other. As long as the patient remains in the bed, the weight of the patient will cause a closed signal to be provided which, when connected to proper electrical circuits, provides an indication of the presence of a patient in the bed. When the patient evacuates the bed, the normal rigidity of the device is sufficient to cause the conductive elements to separate from each other, providing an open circuit which can be employed to indicate the absence of the patient from the bed.

In a second embodiment conductive surfaces are formed directly on the cover members. More particularly, a conductive surface is formed on the bottom surface of the upper cover member and another conductive layer is formed on the top surface of the lower cover member. These conductive layers may be applied in a variety of ways including rolling or spraying conductive ink, paint or other material directly on the plastic cover members. Depending upon the type of material used, the conductive layers may be sprayed onto the cover members using one, two or more passes depending upon the nature of the material and the thickness of the conductive layer which is required to insure full and complete conductivity of the entire strip. The conductive material is sometimes referred to as a conductive flexible ink or paint and the expression "painted on" includes rolling, spraying or any other means of applying a non-rigid material to the cover sheets to attain a flexible conductive layer.

In the second embodiment the cable conductors are connected to the conductive layers.

The second embodiment functions as does the first embodiment and is different substantially only in the use of conductive layers of material rather than separate conductive elements. The switch functions to provide a closed circuit when it is bent or distorted in any way. Bending may be an arcuate bend as when it is more or less uniformly curved by the weight of the patient in a bed or the switch may function to close when it is twisted or otherwise distorted. The switch does not require direct pressure to deform one of the cover members with its conductive layer to contact the conductive layer of the other cover member; that is, the switch functions by deformation rather than depending upon directly applied pressure.

DETAILED DESCRIPTION

Figure 1:
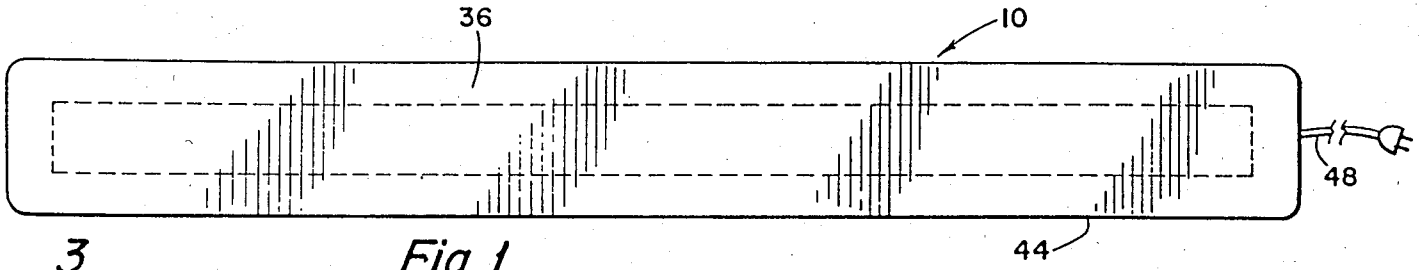
FIG. 1 is a top plan view of a switch for monitoring patient presence in a hospital bed.

Referring to the drawings, the apparatus for monitoring patient presence in a hospital bed is indicated generally by the numeral 10. It includes a base member 12 which is formed of non-electrically conductive, flexible, thin material. An ideal material for use in practicing the invention is high-density polyethylene foam. The base member 12 is of generally rectangular configuration having opposed sides 14 and 16 and ends 18 and 20. Formed in the base member is a cutout opening 22 which is generally rectangular and of dimensions about 1½ to 2½ inches less in width and length than the base member itself. In the typical embodiment of the invention the base member length, from end 18 to end 20, is about 25 to 40 inches long. The width from sides 14 to 16 is preferably about 3¾ to 5 inches. The thickness of the base member is preferably about 1/16 inch. The opening 22 is preferably about 1¾ to 2¼ inches wide and about 22½ to 38½ inches long, depending on the width and length of the base member.

The base member 12 can be described as generally rectangular, and the opening cutout 22 can likewise be described as generally rectangular. However, both may have curved corners if desired.

Affixed to the base member top surface 24 is the first surface 26 of a generally rectangular, thin, electrically conductive member 28. In like manner, the bottom surface 30 of the base member 12 receives the first surface 32 of a second conductive member 34. The conductive members 28 and 34 are preferably of thin metal, such as tin foil, aluminum foil or the like, or of metal surfaces bonded to a plastic backing core, or are of metalized plastic. The dimensions of the conductive members 28 and 34 are substantially equal to or slightly less than that of the base member 12.

Figure 3:
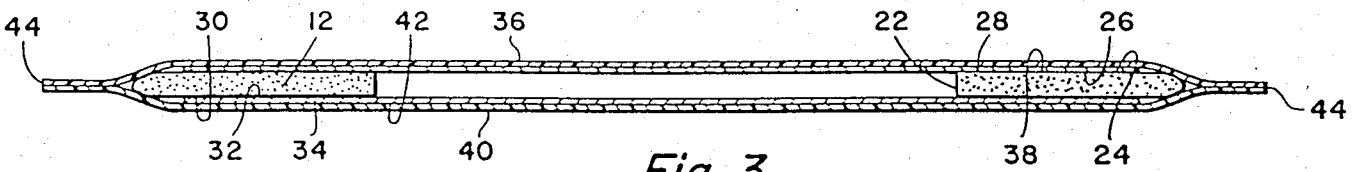
FIG. 3 is a cross-sectional view taken along the line 3—3 of FIG. 2 showing more details of the construction of the apparatus.

As can be seen in FIG. 3, the base member opening 22 causes the conductive members 28 and 34 to be supported in spaced-apart relationship.

Positioned over the conductive members are plastic cover members. Specifically, a top plastic cover member 36 has one surface 38 in engagement with of the first conductive member 28. A bottom cover member 40 engages the second surface 42 of the second conductive member 34. The cover members 36 and 40 are slightly larger in both length and width than that of base member 12 so that they provide an overlapping peripheral edge 44 around the entire apparatus.

The end 18 of base member 12 has a notch 28 formed in it which receives the end portion of a cable 48. The notch may extend at an angle to the end 18 of the base member 50 so that the conductor emerges at or near edge 14 or 16. The cable has a first current carrying conductor 50 which is positioned to contact the first conductive member 28. A second conductor 52 contacts the second conductive element 34. This may be achieved by merely exposing the conductive portions 50 and 52 of the cable 48 to contact the surfaces of the conductive members as the conductive members are secured to the base member.

The apparatus is constructed in this manner. First, the base member 12 is provided with the dimensions as previously set out and with the notch 46 formed in it. An adhesive is applied to the top and bottom surfaces of the base member. Next, the cable 48 is positioned with the end in notch 46 and with conductors 50 and 52 exposed on opposed surfaces of the base member. The conductive members 28 and 34 are then positioned on the base member. The conductive members 28 and 34 thereby engage the conductors 50 and 52 respectively. Next, the cover members 36 and 40 are positioned over the conductive members with adhesive therebetween. The assembly is then pressed securely together by means of a press or rollers to bond the portions to each other. The edge 44 is sealed around the complete assembly. The switch is then completed. It can be seen that all of the elements used to construct the switch are inexpensive and the switch can be expeditiously assembled. This is important in that the device can be considered a throw-away item, that is, it can be limited in usage to one patient. Others may elect to sanitize the device for reuse, which can be easily accomplished since it is hermetically sealed and only the exterior surfaces of the cover are exposed.

The construction of the device means that when no pressure or distorton takes place it is self-rigid so that no contact is provided between the conductive members 28 and 34. However, with the weight of a patient on the device, distortion is sufficient to cause the conductive members 28 and 34 to contact at one place or another, or at a plurality of places along the length of the device, providing a closed circuit.

Figure 2:
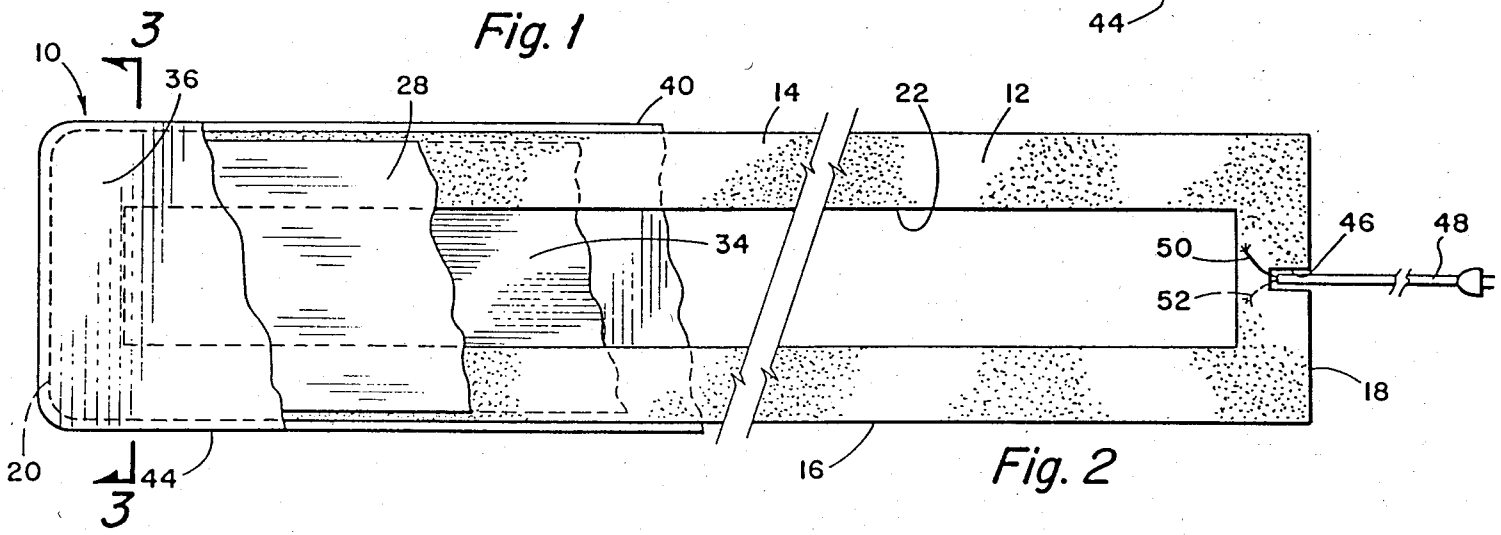
FIG. 2 is a fragmentary plan view of the switch broken away, to show the internal construction.
Figure 4:
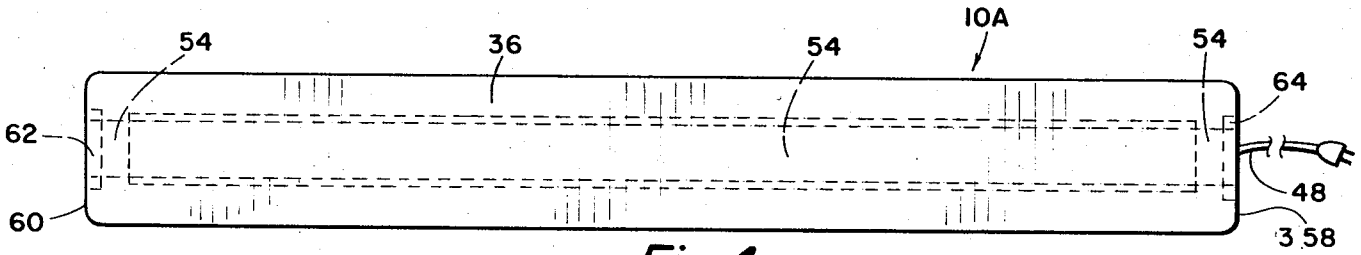
FIG. 4 is a top plan view of an improved embodiment of the invention.
Figure 5:
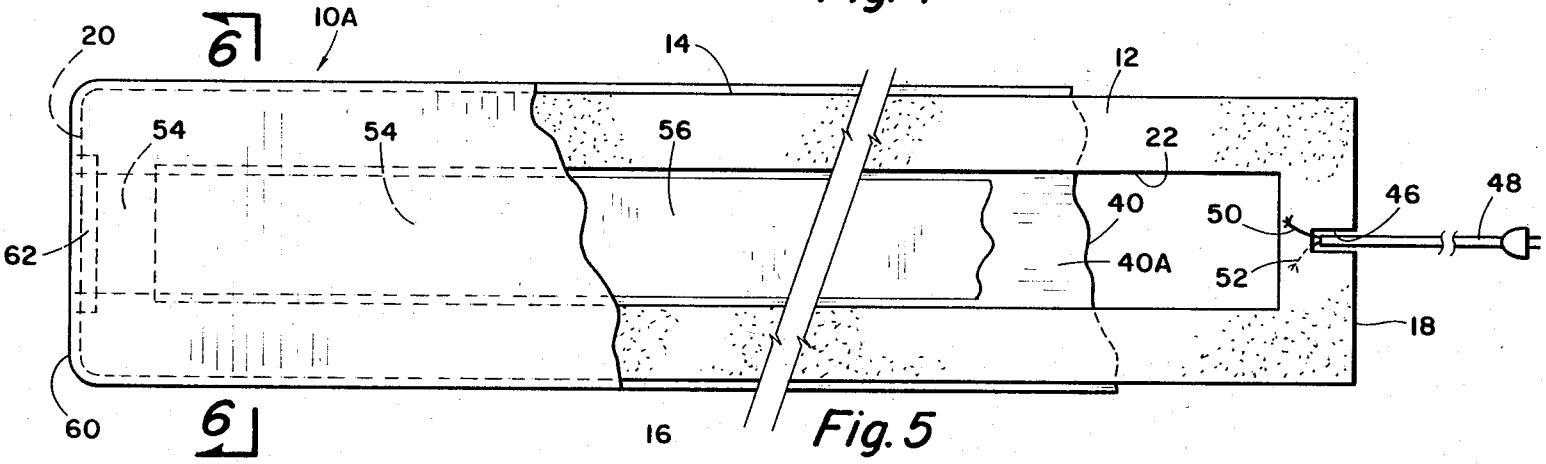
FIG. 5 is a fragmentary plan view improved embodiment, enlarged, which shows more details of the switch construction.
Figure 6:
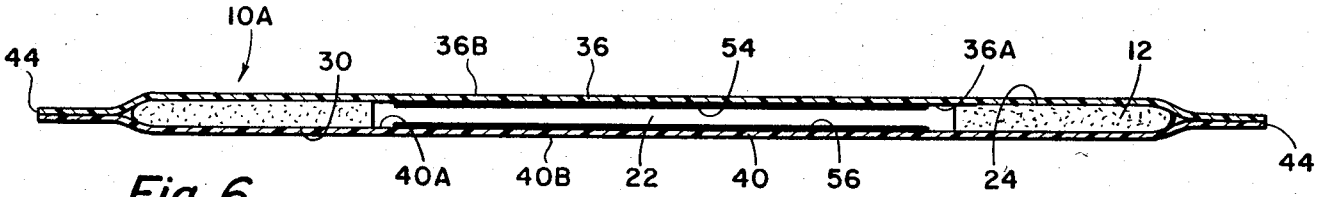
FIG. 6 is a cross-sectional view taken along the lines 6—6 of FIG. 5 showing additional details of the construction of the switch.

Referring to FIGS. 4, 5 and 6 an alternate embodiment of the invention is shown which is considered to be an improvement over the embodiment of FIGS. 1, 2 and 3 in that the cost of manufacture is reduced and the accuracy and dependability of the switch is advanced. The letter 10*a* refers to the alternate embodiment and as seen in FIG. 1 the external appearance, ignoring the dotted lines indicating internal arrangements, of the alternate embodiment is the same as that of the first described embodiment.

Referring to FIGS. 5 and 6, details of the alternate embodiment are shown and include a base member 12 which is formed of non-electrically conductive, flexible, thin material, such as high-density polyethylene foam. The base 12 is of generally rectangular configuration and has opposed sides 14 and 16 and ends 18 and 20. Formed in a base member is a cutout opening 22 which is generally rectangular and has dimensions as described with reference to the first embodiment.

Base member 12 has a top surface 24 and a bottom surface 30. Encompassing the base member is a first nonconductive, thin generally rectangular upper cover member 36 and a similar lower cover member 40. Upper cover member 36 has a bottom surface 36A and a top surface 36B which forms the top exterior surface of the switch. In like manner, lower cover member 40 has a top surface 40A and a bottom surface 40B, the bottom surface forming the exterior bottom of the switch.

Formed on the bottom surface 36A of top cover 36 is a first electrically conductive layer 54 and in like manner formed on the top surface 40A of the lower cover 40 is a conductive layer 56. In one method of manufacturing the switch the conductive layers 54 and 56 run the full length of the upper and lower covers 36 and 40. The width of the conductive layers 54 and 56 is preferably about that of cutout 22 in the base portion 12. As shown in FIGS. 5 and 6 the width of the conductive layers is somewhat less than that of the cutout 22 although the width could be greater than the width of the cutout.

The conductive layers 54 and 56 are formed of conductive ink which may be applied by rolling the ink onto the upper and lower plastic covers 36 and 40 or the ink may be sprayed onto the material which is used to form the covers. If sprayed, more than one layer of conductive ink may be sprayed on. Since the conductive layer may be sprayed, rolled or brushed on it may be generally described as being "painted" onto one surface of each of the upper and lower cover members.

The switch includes a cable 48 with conductors 50 and 52 which are secured to the conductive layers 54 and 56, respectively. The switch is completed by sealing the edges of the cover members beyond the periphery of the base member 12. These may be sealed or bonded such as by the use of adhesives or by heat sealing.

To attain economy of manufacture, a conductive layer may be applied the full length of an elongated strip of plastic material and the strip then cut in lengths to form the upper cover 36 and lower cover 40. When manufactured in this way some means must be provided to prevent the conductive layers from contacting each other at the ends 58 and 60 of the switch. This can be accomplished by inserting small pieces 62 and 64 of thin, non-conductive material between the upper and lower covers 36 and 40 before the edges are sealed or bonded to each other. These thin, non-conductive pieces 62 and 64 may be of plastic material which is heat fused or chemically bonded to the cover portions 36 and 40.

The embodiment of FIGS. 4, 5, and 6 employs the "painted on" conductive layers 36 and 40 in place of conductive members 28 and 34 of the first embodiment and otherwise the switch functions in the same way as in the first described embodiment. When used on a hospital bed the weight of a patient lying or sitting on the bed will distort the switch and thereby cause the conductive layers 36 and 40 to contact each other. This is so whether or not the patient's weight is directly on the switch or not. As long as the switch is placed sufficiently near the portion of the bed where most of the patient's weight will exist, whether the patient is lying or sitting in the bed, the switch will be distorted so as to provide a closed electrical circuit. If the patient moves on the bed so as to shift his or her weight away from the area where the weight of the patient normally occurs, such as the patient moving to the foot of the bed in preparation for exiting from the bed, the decrease in the distortion of the switch will cause the switch to open and such change in circuitry can be employed to provide a signal that the patient is about to or has exited from the bed.

While the invention has been described as it particularly pertains to use in a hospital bed as an example of application of the device, it can be seen that the invention can be applied to use in the beds of nursing homes, in the home of individual users, or for any other switching purpose where or distortion is to be detected.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. An improved switch responsive to distortion by the weight of a patient in a bed comprising an elongated, thin, generally rectangular base member of insulating flexible material providing a top and bottom surface and having an elongated generally rectangular cutout therein;

a first non-conductive, thin, generally rectangular upper cover member of flexible material having a bottom and a top surface;

a second non-conductive, thin, generally rectangular lower cover member of flexible material having a bottom and a top surface, the dimensions of said first and second cover members being of length and width greater than said base member, said base member being received between said upper and lower cover members, and said cover members providing overlapping edges;

a first electrically conductive layer affixed to said bottom surface of said upper cover and a second conductive layer affixed to said top surface of said lower cover, the width of said conductive layers being less than the width of said cover members; and a cable having a first and second conductor, the first conductor having engagement with said first conductive layer and the second conductor having engagement with said second conductive layer, the peripheries of said cover members being sealed, the conductive layers being normally supported by said base member in spaced apart relationship by the memory of said base and said cover member, but which surfaces contact each other through said cutout in said base member when the apparatus is subject to bending or twisting distortion.

2. An improved switch apparatus according to claim 1 wherein said first and second electrically conductive layers are in the form of electrically conductive paint applied to said cover members.

3. An improved switch apparatus according to claim 1 wherein said first and second electrically conductive layers are of a width approximately that of the width of said cutout in said base member.

* * * * *